US009925541B2

(12) United States Patent
Perin et al.

(10) Patent No.: US 9,925,541 B2
(45) Date of Patent: Mar. 27, 2018

(54) PRETENSIONING CABLE ASSEMBLY FOR SECURING A CRUSHER/SHREDDER ROTOR INTACT UPON ITS SHAFT

(71) Applicants: Nolan Perin, Pen Argyl, PA (US); Scott J. Hrbacek, Eureka, MO (US)

(72) Inventors: Nolan Perin, Pen Argyl, PA (US); Scott J. Hrbacek, Eureka, MO (US)

(73) Assignee: American Pulverizer Company, St. Louis, MO (US)

( * ) Notice: Subject to any disclaimer, the term of this patent is extended or adjusted under 35 U.S.C. 154(b) by 748 days.

(21) Appl. No.: 14/121,457

(22) Filed: Sep. 9, 2014

(65) Prior Publication Data

US 2015/0074950 A1 Mar. 19, 2015

Related U.S. Application Data

(60) Provisional application No. 61/960,421, filed on Sep. 18, 2013.

(51) Int. Cl.

| | |
|---|---|
| ***B02C 18/00*** | (2006.01) |
| ***B02C 18/16*** | (2006.01) |
| ***B02C 23/00*** | (2006.01) |
| ***B02C 13/26*** | (2006.01) |

(52) U.S. Cl.

CPC ..... *B02C 18/16* (2013.01); *B02C 13/26* (2013.01); *B02C 23/00* (2013.01); *Y10T 24/3969* (2015.01)

(58) Field of Classification Search

CPC ..... B02C 18/16; B02C 13/26; Y10T 24/3969

USPC ..... 403/369

See application file for complete search history.

(56) References Cited

U.S. PATENT DOCUMENTS

| | | | | |
|---|---|---|---|---|
| 3,673,312 | A * | 6/1972 | Vockroth | H02G 7/056 174/79 |
| 4,009,836 | A | 3/1977 | Strom et al. | |
| 4,519,551 | A | 5/1985 | Ceurvorst | |
| 4,690,340 | A | 9/1987 | Hatanaka | |
| 5,027,491 | A | 7/1991 | Sidney, Jr. et al. | |
| 5,381,972 | A | 1/1995 | Chon et al. | |
| 5,443,216 | A | 8/1995 | Lajoie | |
| 5,454,522 | A | 10/1995 | Ballu | |
| 5,697,562 | A | 12/1997 | LeBlond | |
| 5,799,887 | A | 9/1998 | Kroger | |
| 5,820,045 | A * | 10/1998 | Karra | B02C 2/00 241/207 |
| 6,234,414 | B1 | 5/2001 | DeVitis et al. | |
| 6,357,680 | B1 | 3/2002 | Irwin | |
| 6,527,210 | B1 | 3/2003 | Mecklenfeld | |
| 6,729,566 | B2 | 5/2004 | Greisedieck et al. | |
| 7,140,568 | B2 | 11/2006 | Greisedieck et al. | |
| 8,286,309 | B2 * | 10/2012 | Landry | F16G 11/048 24/122.6 |
| 8,984,720 | B2 * | 3/2015 | Gephart | A61B 17/8861 24/115 R |

* cited by examiner

*Primary Examiner* — Faye Francis
(74) *Attorney, Agent, or Firm* — Paul M. Denk

(57) ABSTRACT

A pretensioning cable assembly for a crusher in which the assembly is an anchor member having a tapered aperture, a cable having an end for being inserted into and through the tapered aperture of the anchor member, and an anchor wedge positioned on the end of the cable for securing the end of the cable in the tapered aperture, for assembly of a crusher.

10 Claims, 9 Drawing Sheets

PRETENSIONING CABLE ASSEMBLY FOR SECURING A CRUSHER/SHREDDER ROTOR INTACT UPON ITS SHAFT

CROSS REFERENCE TO RELATED APPLICATION

This non-provisional patent application claims priority to the provisional patent application having Ser. No. 61/960,421, filed on Sep. 18, 2013.

FIELD OF THE DISCLOSURE

This disclosure generally relates to crushers, such as shredders, hammermills, and ringmills used to process ferrous and non-ferrous scrap material, and more particularly, to a crusher incorporating a pretensioning cable assembly for holding a rotor assembly in place and a pretensioning cable assembly for retrofitting an existing crusher.

BACKGROUND

Crushers, shredders, hammermills, and ringmills are devices used to process scrap (usually metal) materials and stone, to crush or reduce the size of the material so that it can be more easily handled by other equipment for further processing or use.

Crushers are machines that typically include a plurality of hammers or rings mounted about a horizontal rotatable or rotor shaft. As the shaft rotates, the hammers or rings engage and crush whatever material is introduced into the crusher. The hammers or rings can be mounted on the shaft between supports in the form of spiders or center discs arranged or stacked together with spacers to provide a consistent gap between the spiders or discs. At the ends of the discs or spiders is a pair of end discs at each end of the shaft. The shaft extends outside of the crusher machine and the shaft is supported by bearings and rotated by a motor. Typically, the rotor shaft is cylindrical. The use of a cylindrical shaft requires that the supports be positively keyed to the shaft, for example, by using a square or rectangular key on the support and a corresponding keyway on the shaft, so that the support cannot rotate relative to the shaft. The use of a keyway weakens the main shaft and makes removal of the supports and the end discs a much more difficult task. Further, the key will weaken over time and eventually the rotor assembly will shift between the shredder housings. Obviously, this can necessitate a repair of the crusher/shredder, requiring that operation of the crusher/shredder be stopped for the duration of the repair. Depending on the location of the support which is no longer positively fixed with respect to the shaft, the crusher/shredder can be shut down for a considerable period of time.

Typically, the discs and spiders on larger crusher machines are manufactured or assembled with an interference fit where the bores of the discs and spiders are smaller than the diameter of the shaft. Only by heating the discs and the spiders will the bores open up due to thermal expansion and allow for installation on the rotor shaft. Normally the rotor stack is held together with a number of drawbars or tie rods to span the width of the rotor and they are threaded on each end. A drawbar is a solid cylindrical rod structure. One drawbar is placed into each hole, with a typical rotor assembly using four to six bars. A large nut is threaded onto each end of the drawbars and tightened to a high torque value by using a hydraulic wrench. Once the nuts are torqued to a specific value, a fabricated lock plate that has a hex bore and a round contour for the outside profile is placed in the counter bore in the end disc and fit around the nut. This lock plate is then welded to the end plate to prevent the nut from turning.

As the crusher machine is operated, the rotor assembly takes multiple hits and is subjected to substantial shock loads. The bores of the discs or spiders can be damaged by these shock loads over time. Damage to the bores will loosen up the interference fit and cause the discs or spiders to move on the shaft. Any axial movement is resisted by the preload provided by the rotor drawbars. However, if the movement becomes too great, the drawbars can be stressed past their yield point and suffer plastic deformation. Any rotation or movement of a particular disc or spider can also place the drawbar into a shear loading situation, which can break the drawbar. Once the drawbars have failed or broken, the drawbars are useless and no longer protect the crusher. At this point, the crusher will have to be repaired or if the damage is too great then the crusher may have to be discarded.

The present disclosure is designed to obviate and overcome many of the disadvantages and shortcomings experienced with prior drawbars for holding a rotor stack together. Moreover, the present disclosure is related to a pretensioning cable assembly that can hold a rotor stack together or a pretensioning cable assembly that can be used to retrofit or repair existing crushers having drawbars.

SUMMARY OF THE DISCLOSURE

The present disclosure is a pretensioning cable assembly for a crusher which comprises an anchor member having a tapered aperture, a cable having an end for being inserted into and through the tapered aperture of the anchor member, and an anchor wedge positioned on the end of the cable for securing the end of the cable in the tapered aperture.

In light of the foregoing comments, it will be recognized that the present disclosure provides a pretensioning cable assembly for a crusher to hold a rotor assembly in place within the crusher.

The present disclosure provides a pretensioning cable assembly for a crusher that can be easily employed with highly reliable results to hold a rotor assembly in place and to reduce the time required to manufacture or repair the crusher.

The present disclosure also provides a pretensioning cable assembly for a crusher that may be used to retrofit an existing crusher machine that has drawbars.

The present disclosure further provides a pretensioning cable assembly for a crusher that is less prone to failure as compared to a crusher having drawbars.

The present disclosure provides a pretensioning cable assembly for a crusher that requires only a few tools for installation of the assembly or repair of the assembly.

The present disclosure provides a pretensioning cable assembly for a crusher that can be tensioned to a preload value greater than a standard drawbar.

These and other advantages of the present disclosure will become apparent to those skilled in the art after considering the following detailed specification in conjunction with the accompanying drawings.

DETAILED DESCRIPTION OF PREFERRED EMBODIMENTS

Figure 1:
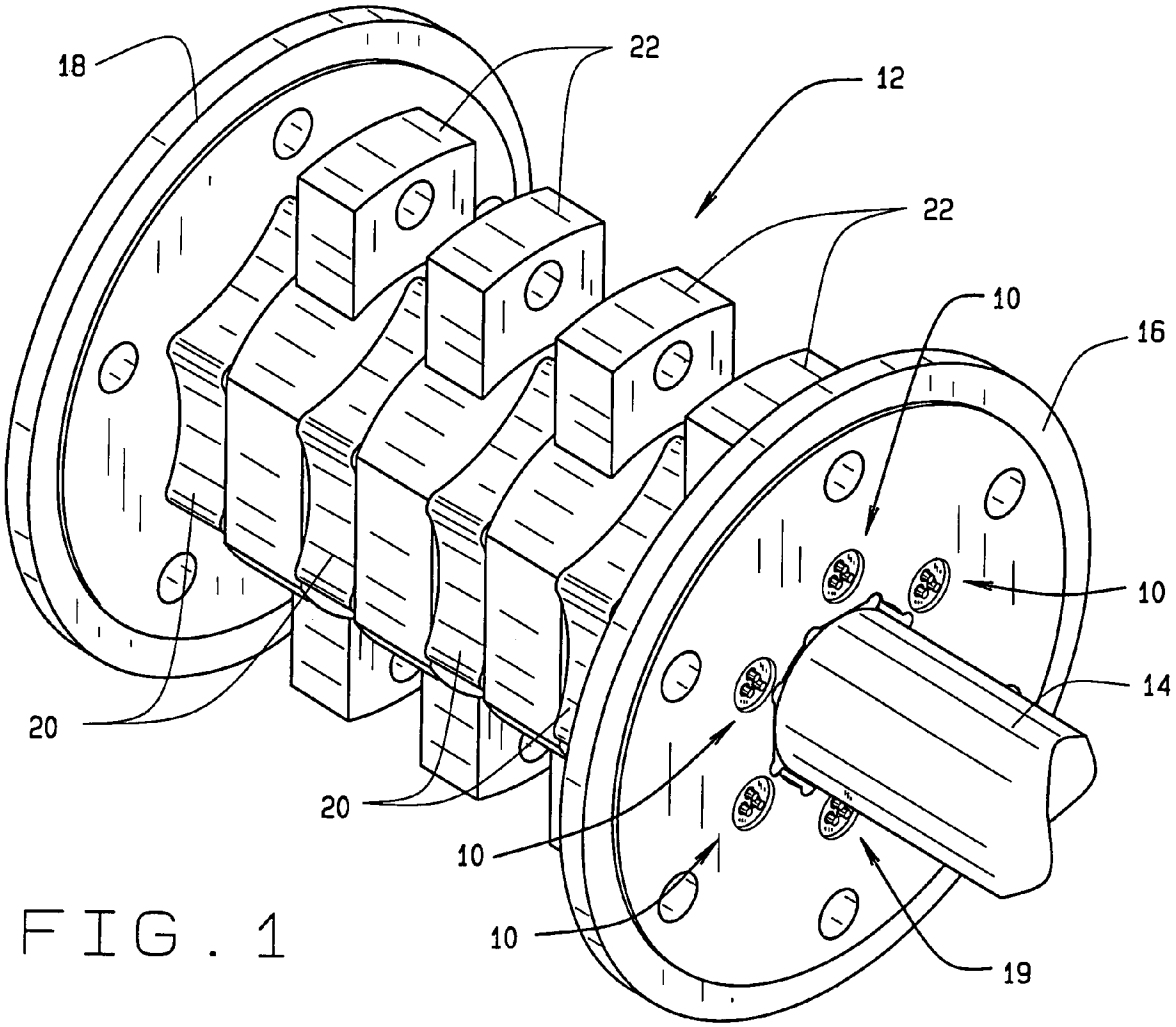
FIG. 1 is a perspective view of a pretensioning cable assembly for a crusher constructed according to the present disclosure being installed in a rotor assembly for a crusher.

Referring now to the drawings, wherein like numbers refer to like items, number 10 identifies a preferred embodiment of a pretensioning cable assembly for a crusher constructed according to the present disclosure. With reference now to FIG. 1, a number of pretensioning cable assemblies 10 are shown being installed on a rotor assembly 12 that may be installed in a crusher (not shown). The rotor assembly 12 includes a rotatable shaft 14, a first end disc 16 positioned on the shaft 14, a second end disc 18 positioned on the shaft 14, a plurality of spacers 20 positioned on the shaft 14, and a plurality of supports or spiders 22 also positioned on the shaft 14. Although not shown, the end of the shaft 14 that extends out from the first end disc 16 may be placed in a bearing assembly and the end of the shaft 14 that extends out from the second end disc 18 may be operatively connected to, and supported by, a drive, such as a motor to rotate the shaft 14 and the rotor assembly 12.

Figure 2:
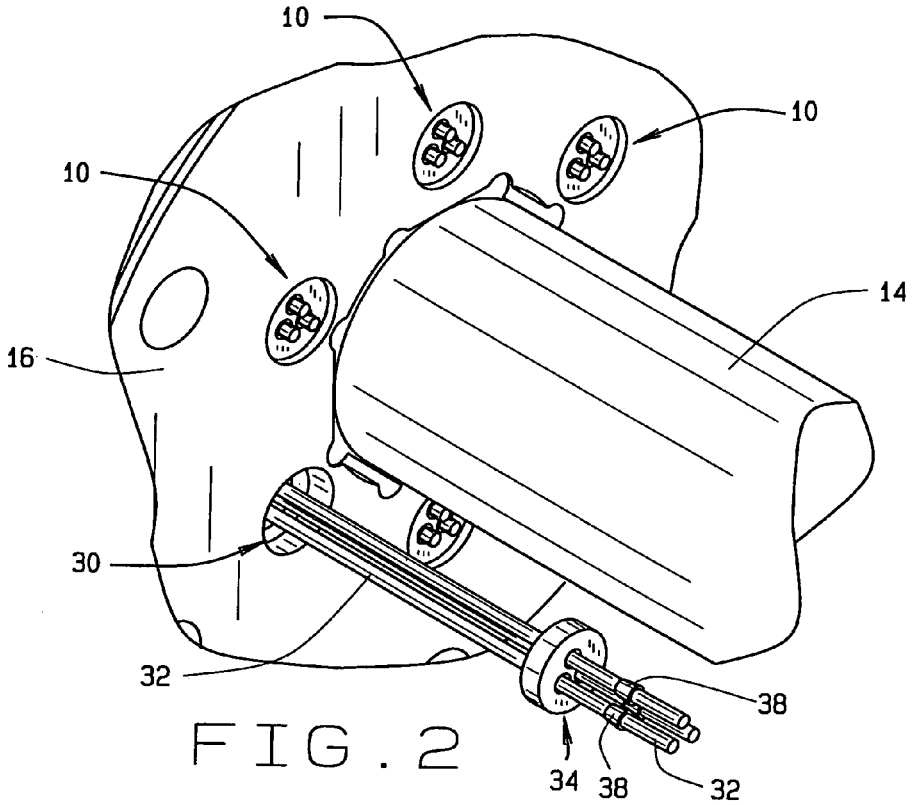
FIG. 2 is a partial perspective view of a pretensioning cable assembly for a crusher constructed according to the present disclosure being inserted into an end disc of a rotor assembly.

FIG. 2 shows one of the pretensioning cable assemblies 10 being inserted into an opening 30 in the first end disc 16. The pretensioning cable assembly 10 comprises one or more cables 32, an anchor member 34 having a number of tapered apertures 36 through which a cable 32 is inserted, and an anchor wedge 38 inserted or positioned on each cable 32. The anchor wedge 38 is used to retain the cable 32 in the anchor member 34. The anchor member 34 is sized and shaped to fit within the opening 30. The opening 30 is the same opening that previously utilized drawbars (not shown) were inserted to hold the rotor assembly 12 together.

Figure 3:
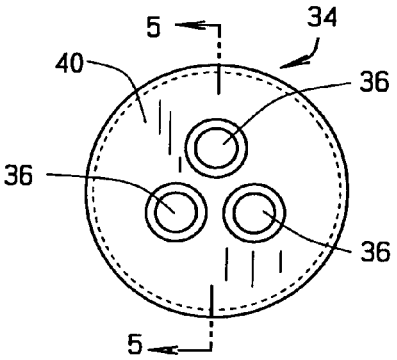
FIG. 3 is a front view of an anchor member constructed according to the present disclosure.

With reference now to FIG. 3, a front perspective view of the anchor member 34 is shown. The anchor member 34 has a chamfered front face and multiple tapered apertures 36. The anchor member 34 is circular in shape and this allows the anchor member 34 to fit within the opening 30 in the first disc end 16. The tapered apertures 36 are sized and shaped to each receive and retain the anchor wedge 38. The apertures 36 also allow the cable 32 to be inserted therethrough. Actually, there may be as many as two to four, or more cable strands that make up a cable structure.

Figure 4:
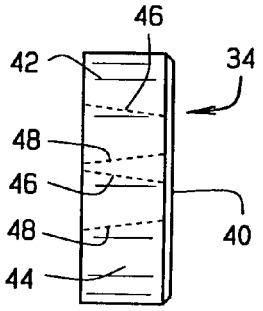
FIG. 4 is a side view of the anchor member shown in FIG. 3 with two of the tapered openings shown in phantom.

FIG. 4 illustrates a side perspective view of the anchor member 34. The anchor member 34 has a back face 42, a circular side face 44, and the chamfered front face 40. Shown in phantom by lines 46 and 48 are two of the tapered apertures 36. The anchor member 34 is puck shaped and can be retained within the opening 30.

Figure 5:
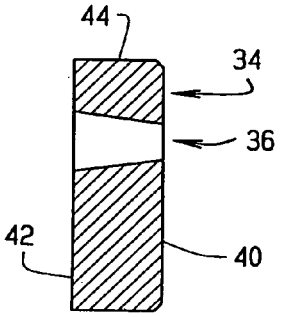
FIG. 5 is a cross-sectional view of the anchor member shown in FIG. 3 taken along the plane of line 5-5 in FIG. 3.

Referring now to FIG. 5, a cross-sectional view of the anchor member 34 is shown. The tapered aperture 36 tapers outwardly from the front face 40 to the back face 42. In this manner, when the anchor wedge 38 is inserted into the tapered aperture 36, the wedge 38 will be securely held in place.

Figure 6:
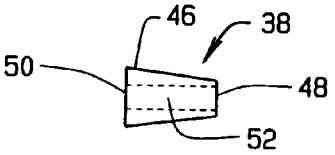
FIG. 6 is a side view of an anchor wedge constructed according to the present disclosure.
Figure 14:
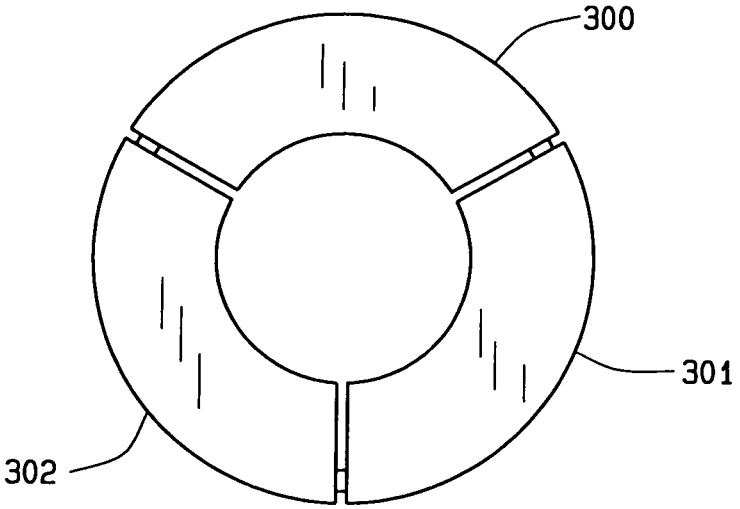
FIG. 14 is a top view of a preferred anchor wedge used in this invention.
Figure 15:
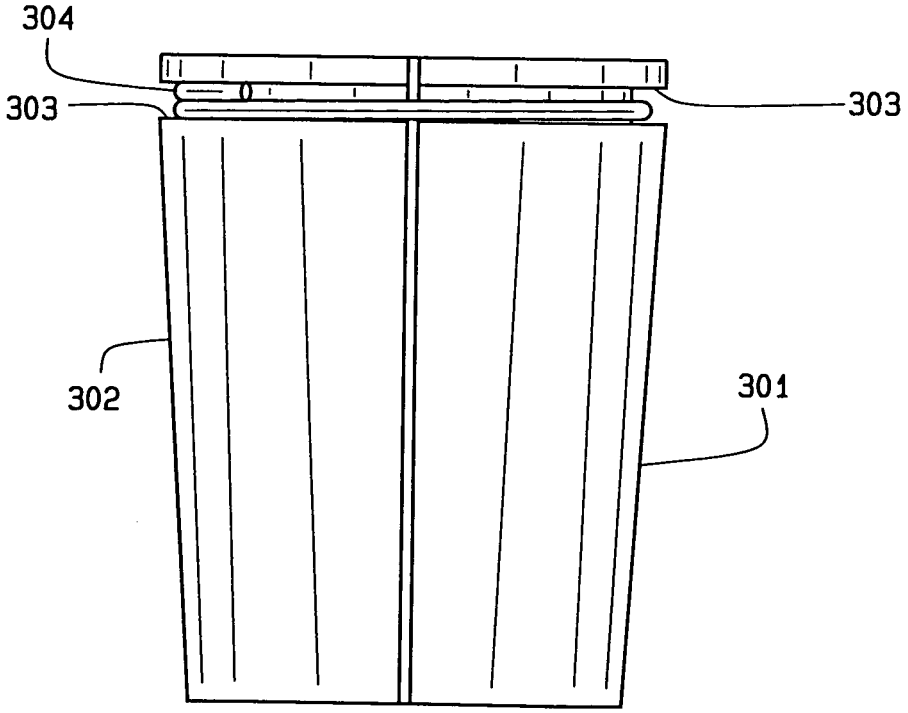
FIG. 15 is a side view of the wedge of FIG. 14.

FIG. 6 illustrates the anchor wedge 38. The wedge 38 has a cylindrical cone shape body 46 having a front face 48 and a back face 50. Shown in phantom is an aperture 52 that extends the entire length of the body 46 between the faces 48 and 50. The aperture 52 allows the cable 32 to be inserted therethrough. The wedge 38 as shown herein in its preferred embodiment, can be seen more specifically in FIGS. 14 and 15. As noted, the wedge is made of three sectors 300-302, which interfit and mate together to form a circular wedge, as noted, and each wedge includes a groove, as noted at 303, that locates therein a retainer spring 304, for holding the segments of the wedge together. Each wedge is formed of an approximately 120° angular structure, as noted in FIG. 14, and they intermate together to form a complete wedge, as can be noted in FIG. 15. As previously reviewed, these wedges are for holding the cables under tension when installed through the anchor member 34.

Figure 7:
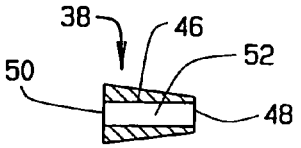
FIG. 7 is a cross-sectional view of the anchor wedge shown in FIG. 6.

With specific reference now to FIG. 7, a cross-sectional view of the anchor wedge 38 is shown. The anchor wedge 38 has the front face 48, the back face 50, and the aperture 52 formed therebetween. The cylindrical cone shape body 46 is sized and shaped to fit and lodge into the tapered aperture 36 of the anchor member 34.

Figure 8:
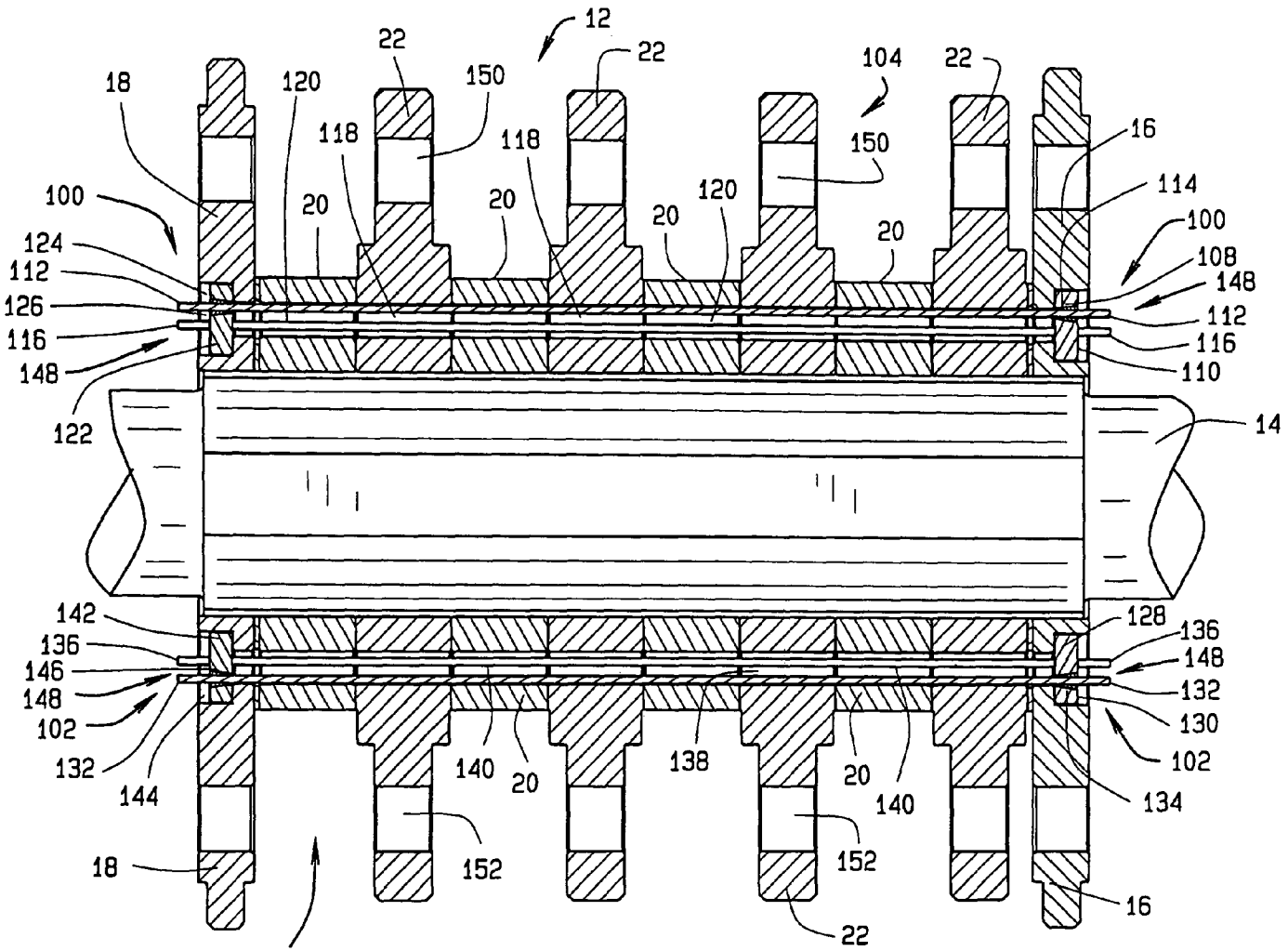
FIG. 8 is a partial cross-sectional view of the pretensioning cable assembly for a crusher constructed according to the present disclosure shown being installed on a rotor assembly.

FIG. 8 illustrates a partial cross-sectional view of a first pretensioning cable assembly 100 and a second pretensioning cable assembly 102 being installed on the rotor assembly 12. The first pretensioning cable assembly 100 and the second pretensioning cable assembly 102 are shown being connected between the first end disc 16 and the second end disc 18. The first pretensioning cable assembly 100 is located at a top portion 104 of the rotor assembly 12 and the second pretensioning cable assembly 102 is positioned along a bottom portion 106 of the rotor assembly 12. The first pretensioning cable assembly 100 comprises a first anchor member 108 inserted into an opening or bore 110 formed in the first end disc 16. A first cable 112 is secured within the first anchor member 108 by use of an anchor wedge 114. A second cable 116 is also connected to the first anchor member 108. Although not shown in this particular view, the second cable 116 is held in place in the first anchor member 108 by use of another anchor wedge 114. The first cable 112 and the second cable 116 pass through the first end disc 16, a number of supports 22 each have a bore or aperture 118, a number of spacers 20 each having a bore or aperture 120, through the second end disc 18 to a second anchor member 122. The second anchor member 122 is positioned within a bore 124 formed within the second end disc 18. A second anchor wedge 126 is used to secure the first cable 112 within the second anchor member 122. Again, although not shown, the second cable 116 is held in place in the second anchor member 122 by using another anchor wedge 126. In this manner, the top portion 104 of the rotor assembly 12 is held together.

The second pretensioning cable assembly 102 comprises a first anchor member 128 inserted into an opening or bore 130 formed in the first end disc 16. A first cable 132 is secured within the first anchor member 128 by use of an anchor wedge 134. A second cable 136 is also connected to the first anchor member 128. The second cable 136 is also held in place in the first anchor member 128 by use of another anchor wedge 134, although this is not shown in this drawing. The first cable 132 and the second cable 136 pass through the first end disc 16, a number of supports 22 each have a bore or aperture 138, a number of spacers 20 each having a bore or aperture 140, through the second end disc 18 to a second anchor member 142. The second anchor member 142 is positioned within a bore 144 formed within the second end disc 18. A second anchor wedge 146 is used to secure the first cable 132 within the second anchor member 142. Again, although not shown, the second cable 136 is held in place in the second anchor member 142 by using another anchor wedge 146. In this manner, the bottom portion 106 of the rotor assembly 12 is held together. It is also possible that more pretensioning cable assemblies 10, 100, or 102 may be used to retain the rotor assembly 12. This is shown in FIG. 1 where there are at least five of the pretensioning cable assemblies 10 illustrated.

Each of the cables 112, 116, 132, and 136 have ends 148 that extend out from the discs 16 and 18. These ends 148 may be chopped or cut off so that the ends 148 are within the openings 110, 124, 130, and 144. Although not shown, a bolt on cover may be inserted into each of the openings 110, 124, 130, and 144 to protect the ends 148 and anchor wedges 114, 126, 134, and 146 when the crusher (not shown) is operating. Also, each of the supports 22 has an upper bore 150 and a lower bore 152. The bores 150 and 152 are used to receive hammer or shafts securing them to the supports 22 (not shown).

In order to install the assemblies 10, 100, or 102, the following procedure is used. The installation of the pretensioning cable assembly 100 will be described, but it is noted that the same procedure is used for the other assemblies 10 or 102. The cables 112 and 116 are fed through the opening 110 in the first end disk 16, through the openings 118 in the supports 22 and the openings 120 in the spacers 20, through the second anchor member 122, and then out of the opening 124 in the second end plate 18. The wedges 126 are placed on the ends 148 of the cables 112 and 116 at the second end plate 18. The wedges 114 are then placed on the ends 148 of the cables 112 and 116 positioned at the first end plate 16. A first anchor member 108 must be installed before wedges 114 can be installed at first end plate 16. A hydraulic tensioning tool (not shown) then pulls the ends 148 of the cables 112 and 116 positioned at the first end plate 16 to a percentage of the tensile strength of the cables 112 and 116. The anchor wedges 126 lock the cables 112 and 116 at the second end plate to the anchor member 122. As the tool continues pulling the cables 112 and 116, it also presses the anchor wedges 114 into the first anchor member 108. Once the proper tension is reached, the tool is released and the cables 112 and 116 are allowed to relax, but the anchor wedges 114 and 126 now lock the cables 112 and 116 to the anchor members 108 and 122. The cables 112 and 116 are now in tension and holding the rotor assembly 12 together. Each of the cables 112 and 116 may consist of seven strands, more or less, wrapped together. As has been explained, the assembly 100 is installed by use of only one tool.

As can be appreciated, the pretensioning cable assembly 10 may be used to retrofit existing crushers having drawbars. For example, the original drawbars may be removed from the crusher to expose the various openings 110, 124, 130, and 144. Once the openings 110, 124, 130, and 144 are exposed, the cables 112, 116, 132, and 136 may be installed as has been previously discussed. Installation of the assembly 10 to retrofit a crusher is also simplified because only one bearing assembly has to be removed. The bearing assembly needs to be removed in order to feed the cables 112, 116, 132, and 136 into the openings 110, 124, 130, and 144 to install the assemblies 100 and 102 and to provide clearance for the hydraulic tensioning tool which needs to be positioned against one of the end discs 16 or 18 during tensioning.

Figure 9:
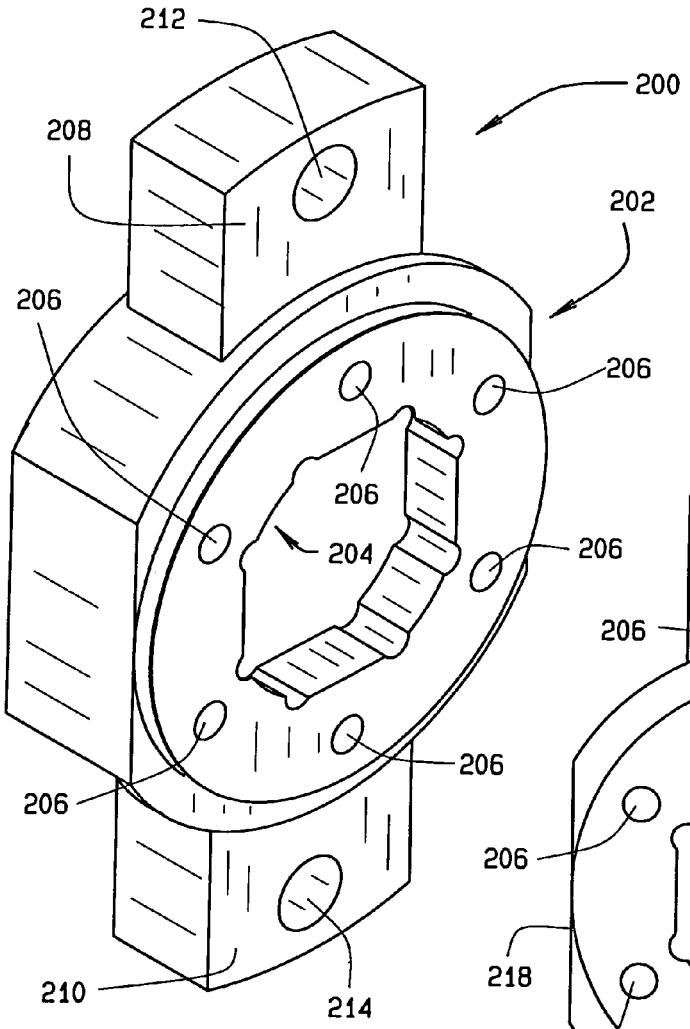
FIG. 9 is a perspective view of a support or a spider constructed according to the present disclosure.

FIG. 9 shows a perspective view of a support 200 that may be positioned on the shaft 14 between the end discs 16 and 18 as part of the rotor assembly 12. The support 200 has a center portion 202 having a central opening 204. The central opening 204 is for receiving the shaft 14 therethrough. Around the central opening 204 are bores or apertures 206 which can have cables, such as cables 112 and 116 (FIG. 8), threaded therethrough. The apertures 206 were previously identified as the bores 118 in FIG. 8. In this particular support 200 there are six apertures 206 positioned around the center portion 202. However, more or less apertures 206 may be used depending upon the particular requirements of the rotor assembly 12. A pair of arms or mounts 208 and 210 extends from the center portion 202. The arm 208 has an opening 212 that is adapted to receive a shaft (not shown) having a hammer (not shown) attached thereto. The arm 210 also has an opening 214 which may receive a shaft (not shown) having a hammer (not shown) attached to the shaft.

Figure 10:
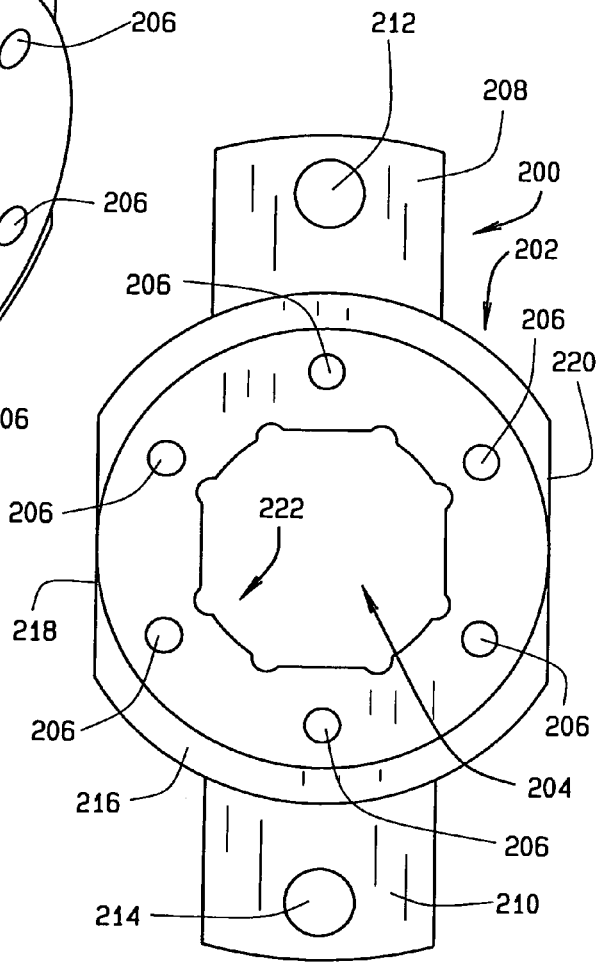
FIG. 10 is a front perspective view of the support or spider shown in FIG. 9.

A front perspective view of the support 200 is shown in FIG. 10. The center portion 202 has a generally round shape 216 having a pair of straight sides 218 and 220. The center opening 204 has a generally square-to-round shape 222 for receiving the shaft 14 of the rotor assembly 12. The support 200 is an example of the support 22 that is used to construct part of the rotor assembly 12.

Figure 11:
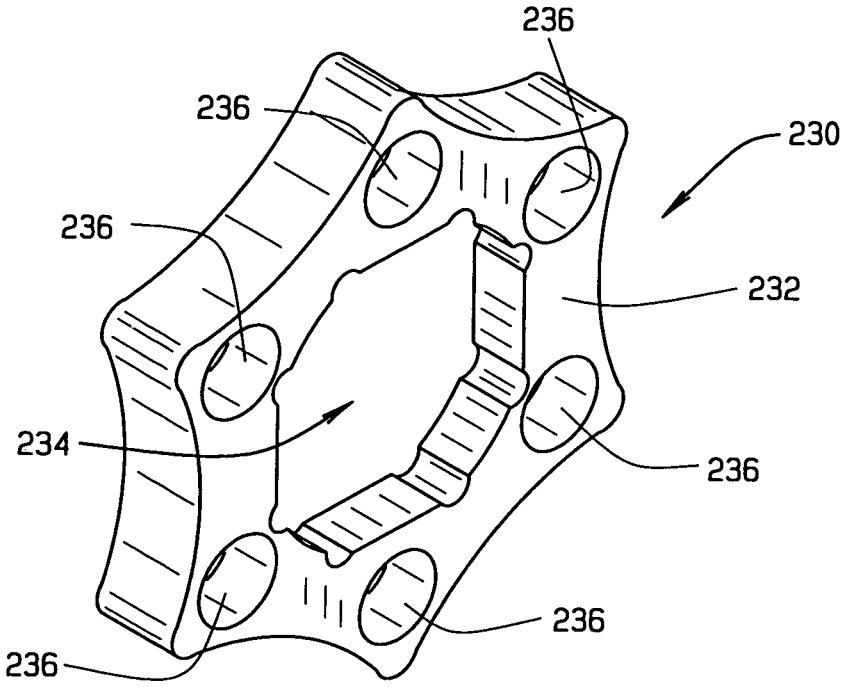
FIG. 11 is a perspective view of a spacer constructed according to the present disclosure.

FIG. 11 depicts a spacer 230 that may be positioned on the shaft 14 between alternating supports 200 and between the end discs 16 and 18 as part of the rotor assembly 12. The spacer 230 has a center portion 232 having a central opening 234. The central opening 234 is for receiving the shaft 14 therethrough. Around the central opening 234 are bores or apertures 236 which can have cables, such as cables 112 and 116 (FIG. 8), threaded therethrough. The bores 236 were previously identified as the bores 120 in FIG. 8. In this particular spacer 230 there are six apertures 236 positioned around the center portion 232. However, more or less apertures 236 may be used depending upon the particular requirements of the rotor assembly 12.

Figure 12:
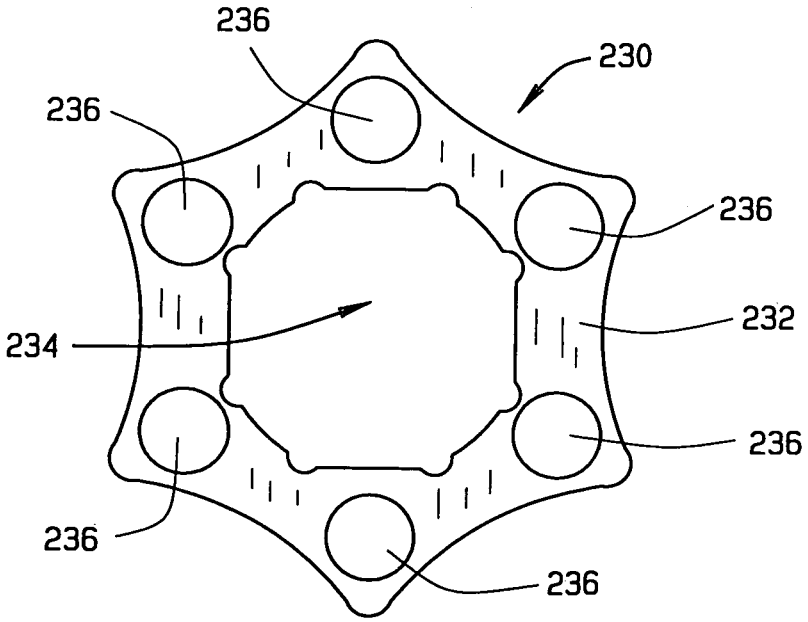
FIG. 12 is a front perspective view of the spacer shown in FIG. 11.
Figure 13:
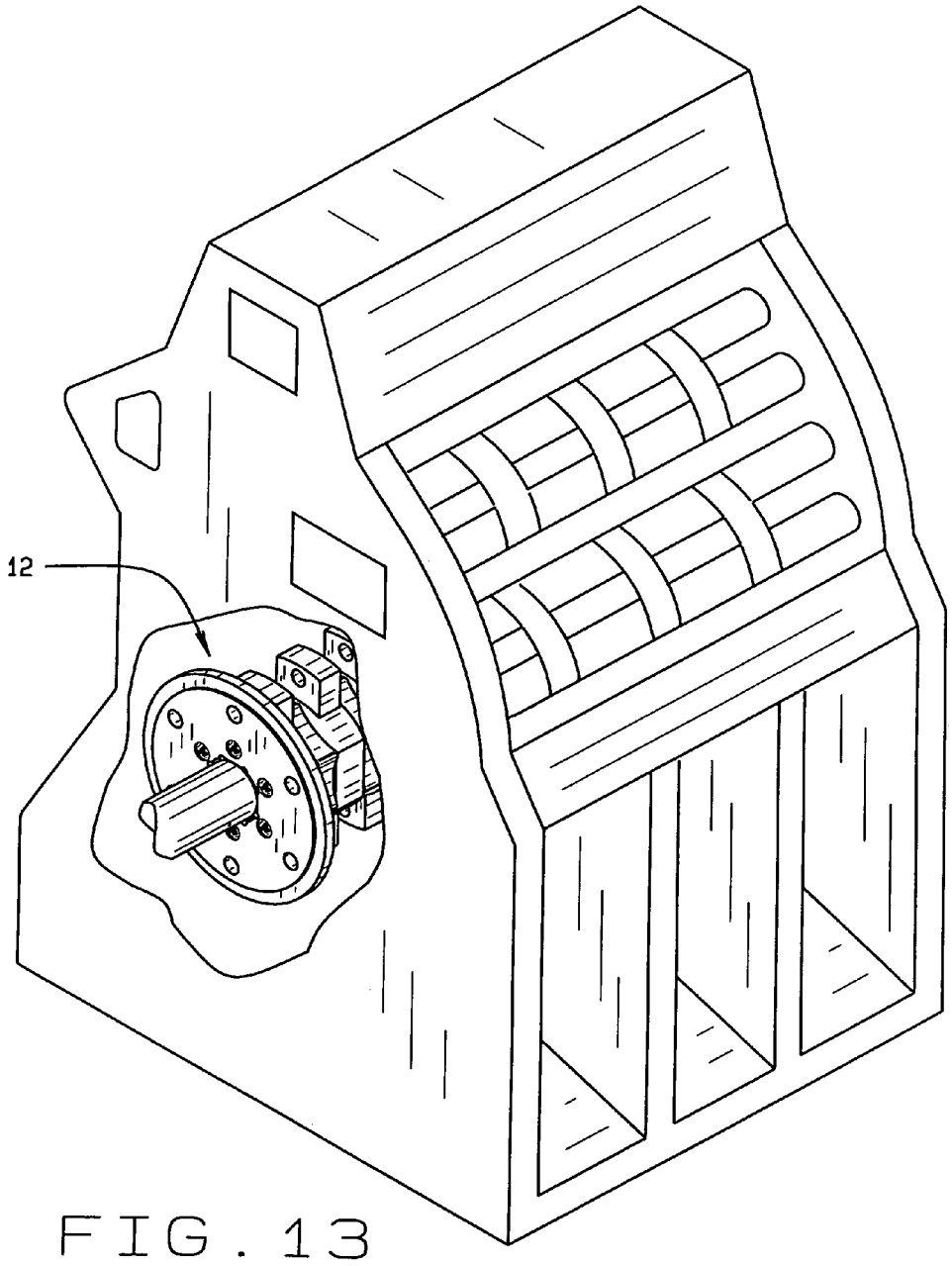
FIG. 13 is an isometric view of the crusher unit incorporating the pretensioning cable assembly for holding the plurality of spacers and supports upon the crusher shaft.

A front perspective view of the spacer 230 is shown in FIG. 12. The center portion 232 has a generally hexagonal shape. The center opening 234 also has a generally octagonal shape for receiving the shaft 14 of the rotor assembly 12. The spacer 230 is an example of the spacer 20 that is used to construct part of the rotor assembly 12.

Figure 16:
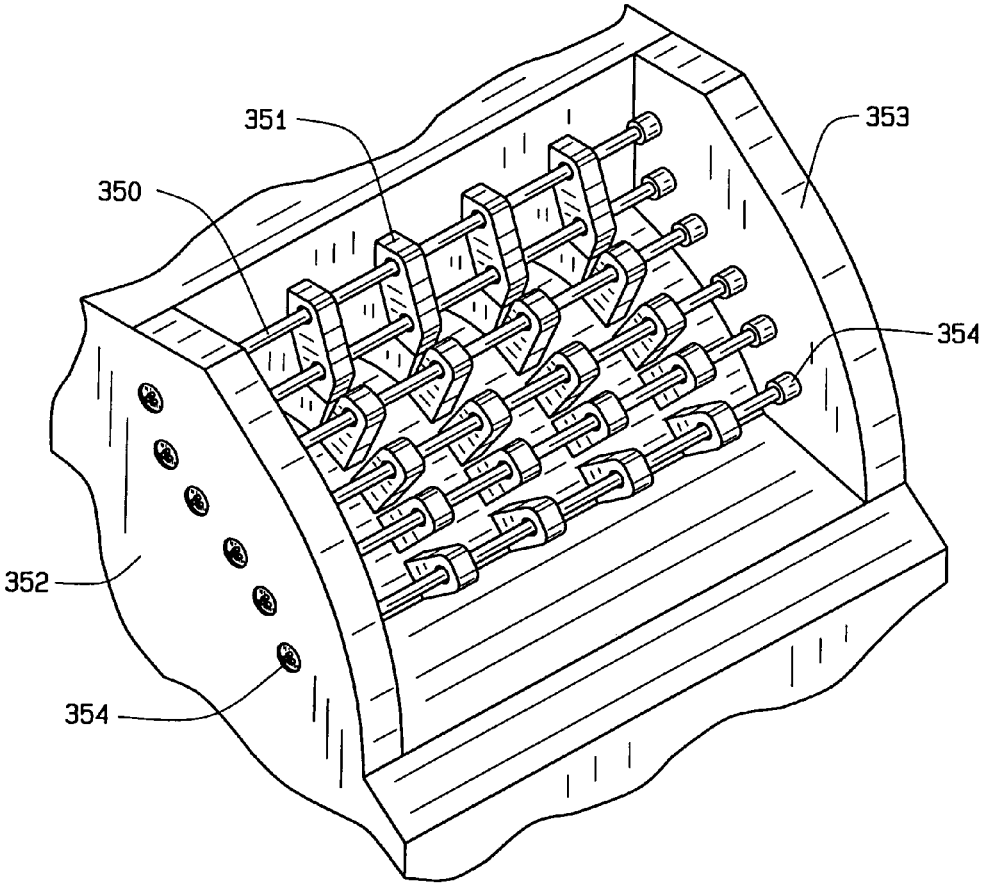
FIG. 16 provides a partial view of the front wall castings that are held together by means of the tensioning cables system of this invention.

As can be noted in FIG. 16, the cable systems 350 can cooperate with the structure 351 for holding the front walls 352 and 353 in place. Similar type of cable assemblies can be used for anchoring the back wall of the castings also in place.

The wedge mounts 354 are used to secure and hold the cables wedged in place between the two walls, as shown.

Figure 17:
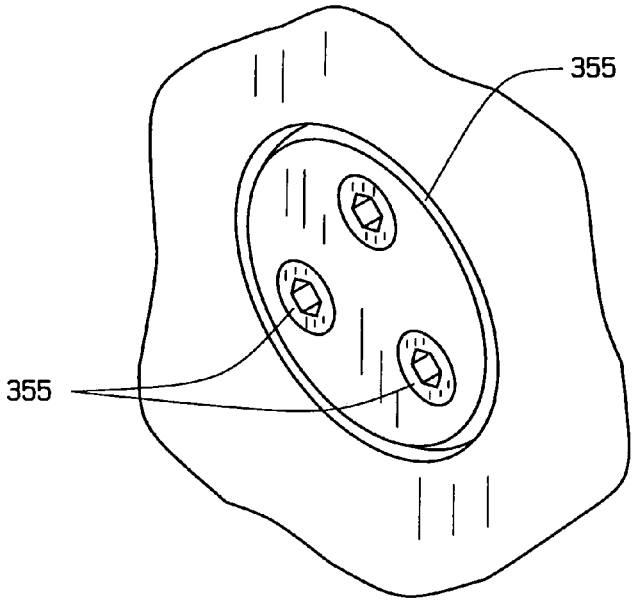
FIG. 17 shows the wedging system for holding three of the cables in place, upon their installation within the crusher/shredder assembly, and show cover plates.
Figure 18:
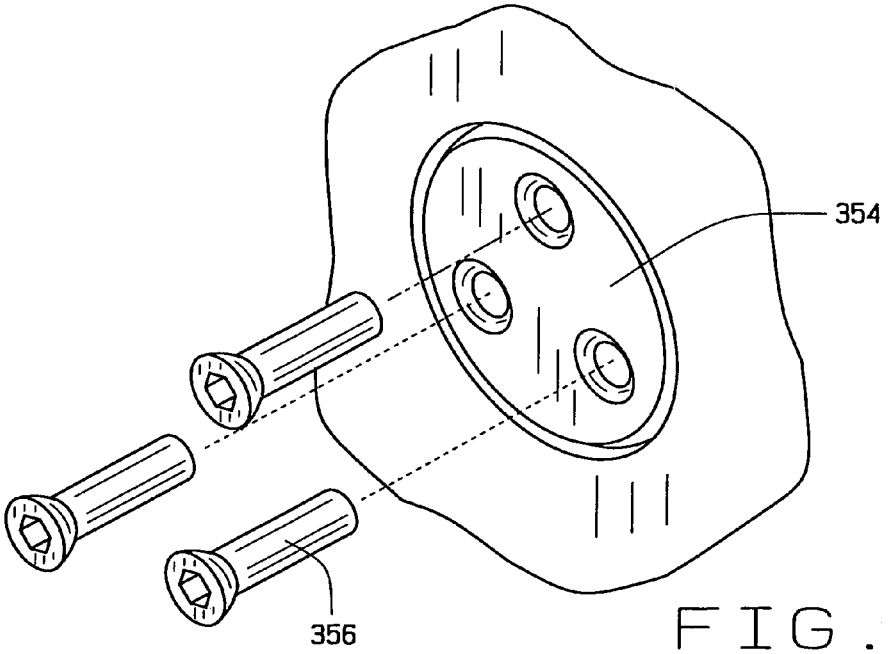
FIG. 18 shows an exploded view where the cable holding means are removed from their wedge mounts, and show cover plates.

FIG. 17 shows one of the wedge mount cover plates 354 retained by at least three of the cover plate mounting bolts 355. FIG. 18 shows an exploded view of the cover plate holding means 356 that thread into anchor member for holding the cover plate in place, once they are pretensioned and installed.

Thus, as can be understood, this entire assembly of the crusher/shredder means can be held together by these pretensioning cables or rods through their installation in the manner as detailed throughout this application. A further advantage of them is that they have a tendency to last longer than utilizing support rods, as done in the prior art, and these pretensioning cables have sufficient elastomeric capabilities to provide a significant advantage to hold the rotor assembly together, its spider or disc, and even the front and back walls of the castings, to anchor them all in place via these pretensioning cables. Their yield factor, in providing a significant advantage in affording additional force in holding the structures fully assembled, even during their impacting operations, has been found to virtually double the yield factor of its operations from that obtained by using the standard drawbars of the prior art.

From all that has been said, it will be clear that there has thus been shown and described herein a pretensioning rod assembly for a crusher. It will become apparent to those skilled in the art, however, that many changes, modifications, variations, and other uses and applications of the subject pretensioning rod assembly for a crusher are possible and contemplated. All changes, modifications, variations, and other uses and applications which do not depart from the spirit and scope of the disclosure are deemed to be covered by the disclosure, which is limited only by the claims which follow.

What is claimed is:

1. A pretensioning cable assembly for a crusher comprising:

a crusher, said crusher having a pair of spaced apart side walls;

a rotary assembly, said rotary assembly including a shaft mounted for rotation between said side walls, said rotary assembly including supports and crushers mounted onto said shaft, first and second end discs applied to the rotor assembly outwardly of said mounted supports and crushers, said rotor assembly mounted for rotation with respect to said sidewalls to perform its crushing function;

at least one aperture provided in each end disc, and an anchor member provided for seating in each disc aperture, each anchor member having at least one tapered aperture provided therethrough;

a cable having a pair of ends, and each end of said cable provided for being inserted into and through the tapered aperture of an anchor member;

an anchor wedge positioned on each end of said cable for securing the ends of said cable in the tapered aperture of each anchor member; and wherein said pretensioned cable assembly including pretensioned cables for spanning through said supports and crushers and extending between the end discs proximate the side walls, and when installed acting to hold the rotary assembly together during usage and application for a crushing operation.

2. The pretensioning cable assembly of claim 1 wherein the anchor member comprises a front face and a back face and the tapered aperture tapers outwardly from the front face to the back face.

3. The pretensioning cable assembly of claim 1 wherein the anchor wedge has a cylindrical cone shape body having a front face, a back face, and an aperture extending between the faces, and said aperture provided for receiving the cable therethrough.

4. The pretensioning cable assembly of claim 1 wherein the anchor member comprises a chamfered front face.

5. The pretensioning cable assembly of claim 1 wherein the cable is formed from strands of cables.

6. The pretensioning cable assembly of claim 1 wherein the anchor wedge has a cylindrical cone shape body having a front face, a back face, an aperture extending between the faces and the body tapers outwardly from the front face to the back face.

7. The pretensioning cable assembly of claim 6, wherein each anchor wedge is formed of three segments, said three segments interfitted together to form a circular tapered anchor wedge, and a retainer holding said segments of the anchor wedge together.

8. The pretensioning cable assembly of claim 7, wherein each segment of said tapered anchor wedge is formed at approximately 120°, and said segments are secured together to form a complete circular tapered anchor wedge during usage.

9. The pretensioning cable assembly of claim 1, wherein there are three cables provided for inserting through the tapered apertures of the anchor members.

10. The pretensioning cable assembly of claim 9, wherein there are six anchor members mounted to each end disc for securing of pretensioned cables, and for holding the rotor assembly together during usage.

* * * * *